US005392962A

United States Patent [19]

Meshberg

[11] Patent Number: 5,392,962

[45] Date of Patent: Feb. 28, 1995

[54] ATOMIZING PUMP

[76] Inventor: Philip Meshberg, 2770 S. Ocean Blvd., Apartment 602, Palm Beach, Fla. 33480

[21] Appl. No.: 272,446

[22] Filed: Jul. 8, 1994

Related U.S. Application Data

[63] Continuation of Ser. No. 999,330, Dec. 31, 1992, abandoned.

[51] Int. Cl.[6] ..... B05B 9/043

[52] U.S. Cl. ..... 222/321

[58] Field of Search ..... 222/321, 383, 385, 255; 239/333; 417/510, 511

[56] References Cited

U.S. PATENT DOCUMENTS

| | | | |
|---|---|---|---|
| 2,878,012 | 3/1959 | Crites . | |
| 3,194,447 | 7/1965 | Brown | 222/321 |
| 3,211,346 | 10/1965 | Meshberg . | |
| 3,295,846 | 1/1967 | Robertson . | |
| 3,321,200 | 5/1967 | Polhemus et al. . | |
| 3,331,559 | 7/1967 | Fedit . | |
| 3,359,917 | 12/1967 | Cooprider | 222/321 X |
| 3,362,344 | 1/1968 | Duda | 222/321 X |
| 3,746,260 | 7/1973 | Boris . | |
| 4,025,046 | 5/1977 | Boris . | |
| 4,113,145 | 9/1978 | Meshberg . | |
| 4,122,982 | 10/1978 | Giuffredi . | |
| 4,144,987 | 3/1979 | Kishi . | |
| 4,241,853 | 12/1980 | Pauls et al. . | |
| 4,273,290 | 6/1981 | Quinn . | |
| 4,389,003 | 6/1983 | Meshberg . | |
| 4,597,475 | 7/1986 | Lässig et al. . | |
| 4,607,765 | 8/1986 | Ruscitti | 417/511 |
| 4,674,911 | 6/1987 | Gertz . | |
| 4,733,692 | 3/1988 | Kotake et al. . | |
| 4,856,677 | 8/1989 | Brunet et al. | 222/321 |
| 4,895,352 | 1/1990 | Stumpf . | |
| 4,911,336 | 3/1990 | Blake | 222/385 X |
| 4,911,706 | 3/1990 | Levitt . | |
| 4,915,263 | 4/1990 | Cobra . | |
| 4,974,820 | 12/1990 | Nakanishi . | |
| 5,002,228 | 3/1991 | Su | 239/333 |
| 5,190,192 | 3/1993 | Ling et al. | 222/321 |
| 5,217,148 | 6/1993 | Cater | 222/321 |
| 5,228,602 | 7/1993 | Maas et al. . | |

*Primary Examiner*—Andres Kashnikow
*Assistant Examiner*—Kenneth DeRosa
*Attorney, Agent, or Firm*—Kenyon & Kenyon

[57] ABSTRACT

The invention is an atomizing pump for dispensing a quantity of liquid in a fine spray. The pump mechanism is constructed entirely of plastic, including the inlet and outlet valves, the piston, pump housing, and spring. This construction allows the pump to be easily recycled. The pump can also be constructed using two biasing springs. The first spring is used only to return the pump piston; the second spring is used only to bias the outlet valve. In this manner, the person operating the pump only presses downwardly against the force of the first spring, and not the second. As a result of this biasing arrangement, less actuation force is required.

25 Claims, 3 Drawing Sheets

ATOMIZING PUMP

This application is a continuation of application Ser. No. 07/999,330, filed on Dec. 31, 1992, now abandoned.

BACKGROUND OF THE INVENTION

Atomizing pumps which dispense a quantity of liquid in a fine spray are generally constructed with a metallic coil spring which is used to bias the pump piston axially outwardly. More often than not, the spring is located within the pump chamber, or below the pump chamber in a location through which liquid flows on its way to the pump chamber. Examples of pumps which include a metallic coil spring in the pump chamber include U.S. Pat. Nos. 3,211,346; 3,746,260 and 4,113,145. Examples of pumps which include a metallic coil spring in a location through which liquid flows on its way to the pump chamber include U.S. Pat. Nos. 4,025,046; 4,122,982 and 4,389,003. In all of these pumps, the liquid to be dispensed contacts the metallic spring as it passes from the container to the atmosphere via the pump.

Although many atomizing pumps are still manufactured with metallic valve mechanisms, other pumps have been created which eliminate the need for metallic valve mechanisms. An example of the latter is shown in U.S. Pat. Nos. 4,113,145; 4,144,987 and 4,389,003. However, these pumps still include a metallic coil spring which is in contact with the liquid to be dispensed. The contact of liquids with metallic elements, either valves or springs, can result in unwanted chemical reactions which can degrade either the liquid or the metallic elements. Furthermore, the existence of metallic parts within a plastic pump makes the pump difficult to recycle, as the metallic parts must be removed from the plastic before it is remelted.

Another form of atomizing pump which has come into use in recent years is the so-called "precompression" pump. This type of pump has an outlet valve which opens in response to a predetermined minimum pressure in the chamber. This is generally accomplished by including a valve member or stem within the pump chamber which has a net upwardly-facing surface upon which pressure acts. When the pressure acting on this valve member is sufficiently high, it overcomes a biasing spring, pushing the valve member downwardly and opening the outlet valve. Examples of these types of pumps are found in U.S. Pat. Nos. 3,399,836; 4,025,046; 4,144,987 and 4,389,003. These pumps use a single metallic coil spring, which urges the valve member as well as the piston member upwardly. Because this one spring is used to resist pressure action on the valve stem and to return the pump piston, the spring must be sufficiently stiff to provide both functions. However, this high stiffness requires an operator to press down with a fairly high actuation force on the actuator to ensure spraying. High actuation force is sometimes difficult to achieve for the elderly, children and some women; the result is that these precompression pumps are sometimes perceived as difficult to operate by certain people.

SUMMARY OF THE INVENTION

The present invention is directed to an atomizing pump for dispensing a quantity of fluid in a fine spray. The invention is specifically directed to a pump which is manufactured entirely out of plastic, so that it may be recycled easily. The all-plastic construction also ensures that the liquid does not come into contact with metallic parts, causing degradation of the parts or the liquid. The invention is also directed to a pump which is constructed so that it requires a lower force to actuate.

In one embodiment of the present pump, a single spring is used which is located between the mounting cup and the actuator. The structure of the piston and stem are such that this location of the spring allows return of the piston under the influence of the spring. A second embodiment of the present pump includes two springs, one which acts to return the piston, and one which closes the outlet valve. In this second embodiment the main pump spring is located between the mounting cup and the actuator, while the valve spring is in the outlet passage. This arrangement ensures that the main pump spring is only strong enough to return the piston, making the pump actuator much easier to operate by requiring a smaller force than those pumps in which a single spring returns the piston and closes the outlet valve.

DETAILED DESCRIPTION

Figure 1:
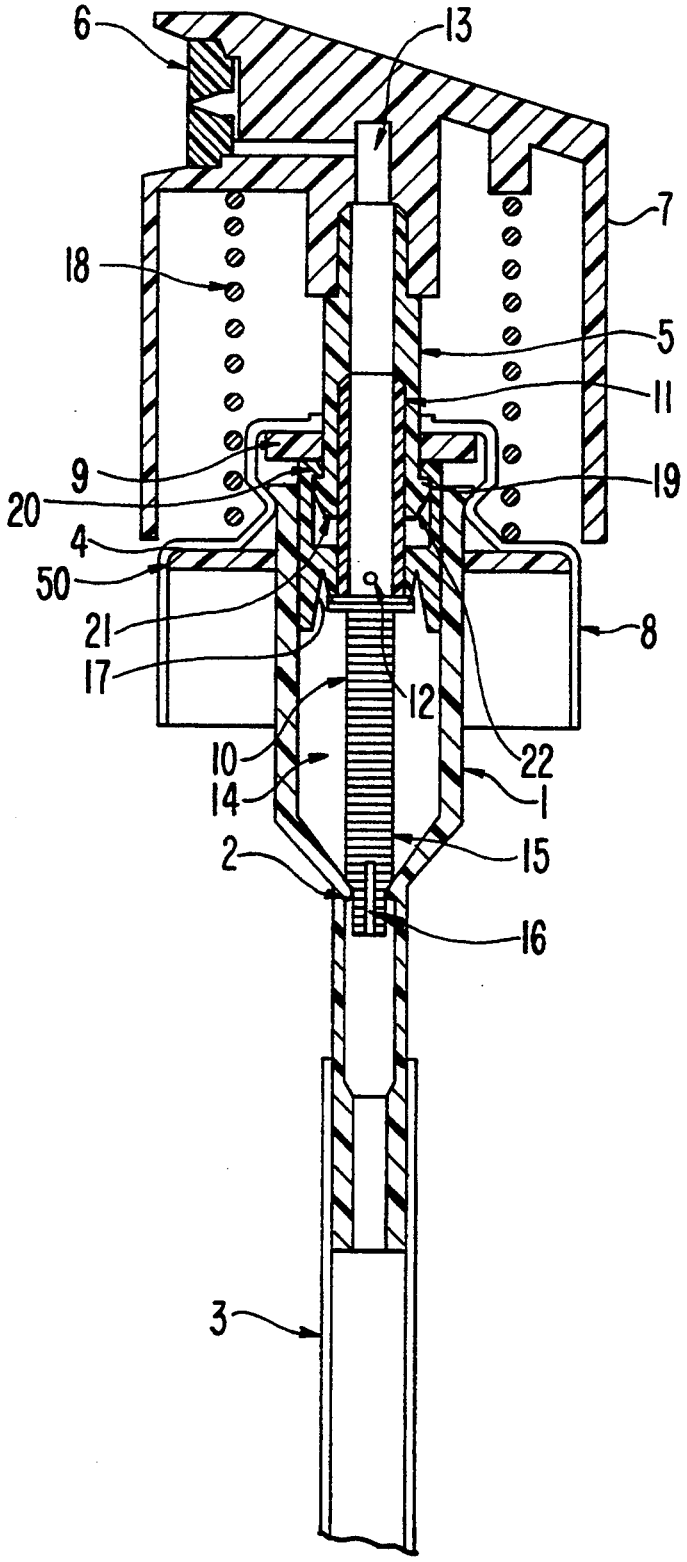
FIG. 1 is a cross-sectional view of a first embodiment of the present invention.

FIG. 1 depicts a first embodiment of the present invention. This embodiment is an improvement over the pump disclosed in U.S. Pat. No. 4,113,145, the disclosure of that patent being incorporated herein by reference. The embodiment of FIG. 1 includes a pump housing 1, which includes an inlet opening 2 at its lower end. This inlet opening can be formed with a circular bead. The inlet opening 2 is in fluid communication with a dip tube 3 which extends into the bottom of a liquid container or bottle. The pump mechanism can be attached to this container or bottle by means of a mounting cup 8, which is crimped, screwed or snapped onto the top opening of the container or bottle. A seal 9 may be used to seal the pump housing 1 against the mounting cup 8 to prevent leakage. A gasket 50 may be used to seal the mounting cup 8 against the container or bottle.

Sliding within the housing 1 is a pump piston 4. Piston 4 is slidingly connected to a plunger tube 5, which is in fluid communication with an atomizing nozzle 6. An actuator 7 is connected to the plunger tube 5, and holds the atomizing nozzle 6. Also sliding within the housing 1 is a valve stem 10. Valve stem 10 acts to open and close the inlet and outlet valves for the pump. Valve stem 10 includes an upper portion 11 which is press or snap fit into the plunger tube 5. Upper portion 11 is hollow, and includes an outlet port 12 through its side. The upper portion 11 slidingly supports the piston 4 for reciprocal movement. The hollow portion of upper portion 11, along with the hollow portion of plunger tube 5 and passage 13 through actuator 7, act as an outlet passage for fluid from the pump chamber 14.

Lower portion 15 of valve member 10 extends through opening 2. Lower portion may include slots 16 at its lowermost end, or the lowermost end may be tapered. The slots 16 or taper provide a fluid passage between dip tube 3 and pump chamber 14 when the valve member 10 is in its uppermost position (as shown in FIG. 1). In its uppermost position, outlet port 12 is located above a lower rim 17 on piston 4, so that there is no fluid passage between pump chamber 14 and outlet passage 12.

A non-metallic spring 18, made preferably of plastic, is located between the mounting cup 8 and the actuator 7. Spring 18 can be a helical-coil-type spring or a bellows-type spring. This spring acts to urge the actuator 7, and thus plunger tube 5 and valve stem 10, upwardly. Plunger tube 5 includes an outwardly-projecting rim 19 which engages an inwardly-extending rim 20 on piston 4 when the plunger tube moves upwardly. The operation of this mechanism will be described below.

In operation, the pump is initially held in the rest position shown in FIG. 1. Finger pressure is then applied to the top of the actuator 7, against the force of spring 18. Downward movement of actuator 7 moves down plunger tube 5 and valve member 10. The downward movement of valve member 10 moves slots 16 below the opening 2, thus sealing off the dip tube 3 from the pump chamber 14. Downward movement of valve member 10 also causes outlet port 12 to slide below lower rim 17 on piston 4, thus providing fluid communication between pump chamber 14 and spray nozzle 6. Further downward movement of valve member 10 causes lower rim 21 of plunger tube 5 to engage upper rim 22 of piston 4. Continued downward movement of valve member 10 thereafter pushes piston 4 downwardly, pressurizing the fluid in pump chamber 14, so that it exits the nozzle 6 as a fine mist.

Upon release of the actuator 7 by an operator's finger, spring 18 urges actuator 7 upwardly, pulling plunger tube 5 and valve member 10 upwardly. Upward movement of valve member 10 causes outlet port 12 to slide within lower rim 17, closing off fluid communication between the pump chamber 14 and nozzle 6. Upward movement of valve member 10 also causes outwardly projecting rim 19 to engage inwardly-extending rim 20 on piston 4, so that further upward movement of valve member 10 pulls piston 4 upwardly. Upward movement of piston 4 causes an increase in the volume of the pump chamber 14, and a resulting decrease in the pressure in that chamber. When valve member 10 moves far enough up, slots 16 allow fluid communication between dip tube 3 and pump chamber 14. Liquid is then drawn up into pump chamber 14, from the container and via the dip tube 3, by the reduced pressure in the pump chamber 14.

As can be seen from the above description, the location of the spring member is such that it does not come into contact with any of the liquid being dispensed. Furthermore, each of the components can be manufactured of a plastic material (as can the bottle or container, which is not shown), so that the entire dispensing apparatus can be recycled without the need to remove metallic or non-plastic parts.

Figure 2:
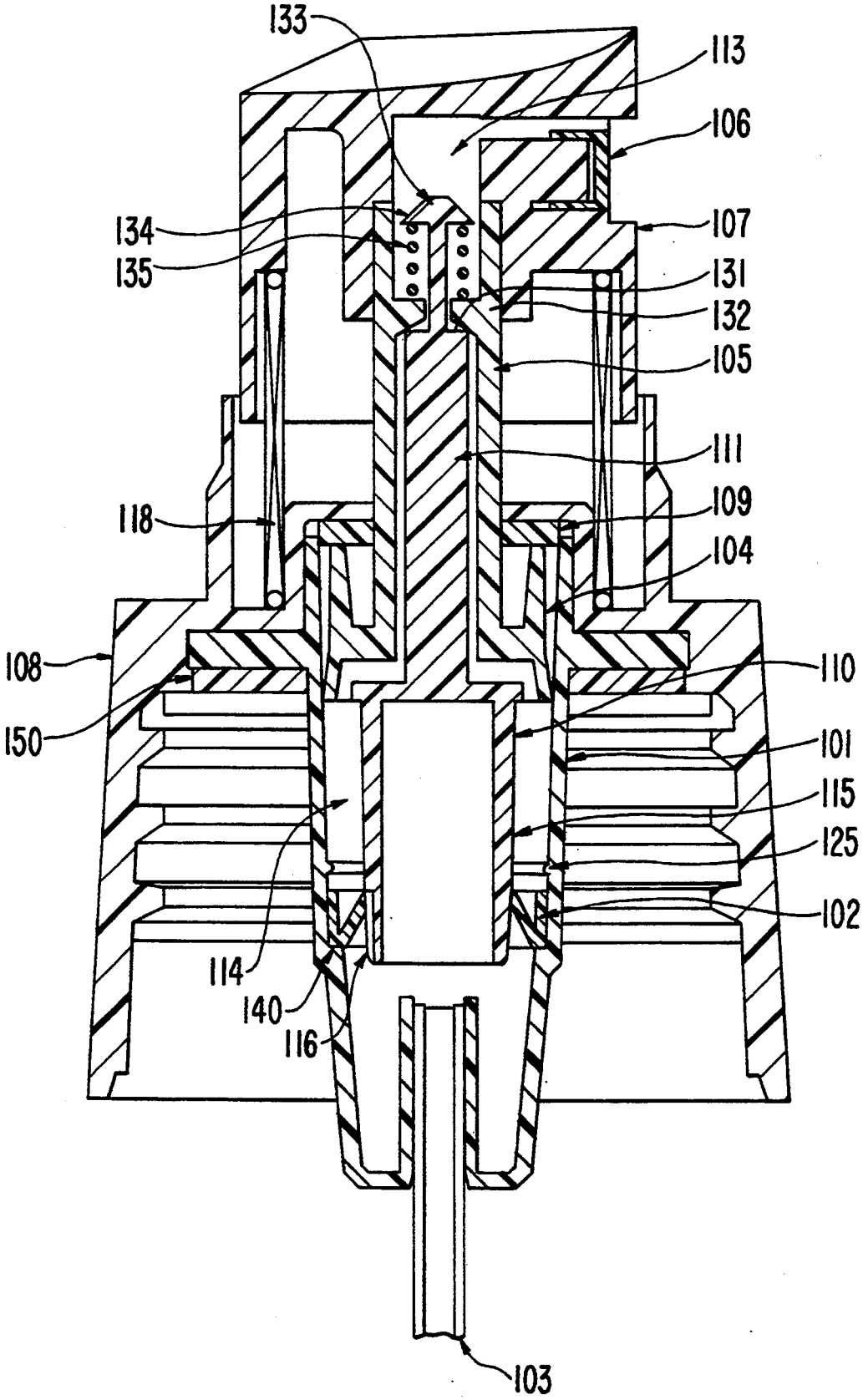
FIG. 2 is a cross-sectional view of a second embodiment of the present invention.

FIG. 2 shows a second embodiment of the present invention. As in the first embodiment, all the parts shown are manufactured of a plastic material. This embodiment is a modification of the device shown in U.S. Pat. No. 4,389,003, the disclosure of that patent being incorporated herein by reference. The pump shown in FIG. 2 is a "precompression" pump—a pump in which the outlet valve opens only when a certain minimum pressure exists within the pump chamber.

As shown in FIG. 2, the pump includes a pump housing 101, within which a piston 104 slides. Piston 104 is integrally formed with plunger 105, which is in turn snap or press fit onto actuator 107. Actuator 107 holds atomizing nozzle 106, and includes a passage 113 for fluid to travel through the actuator 107 to the nozzle 106. Pump housing 101 includes at its lower end a sliding seal 102, which slidingly engages the inner wall of housing 101, as well as a valve member 110 within the pump chamber. A bead 125 on the inner wall of housing 101 acts to restrain upward movement of sliding seal 102. Sliding seal 102 acts as the opening to the lower portion of pump chamber 114, and is in fluid communication with a dip tube 103 which extends into the bottom of a liquid container or bottle. The pump mechanism is mounted to the container or bottle by means of a mounting cup 108, which is crimped, screwed or snapped onto the top opening of the container or bottle. A seal 109 may be used to seal the pump housing 101 against the mounting cup 108 to prevent leakage. A gasket 150 may be used to seal the mounting cup 108 against the container or bottle.

Valve member 110 has an upper portion 111 and lower portion 115. Lower portion 115 of valve member 110 extends through the sliding seal 102. Lower portion includes slots 116 at its lowermost end, or its lowermost end may be tapered. As an alternative, the seal 102 may include slots for fluid flow. The slots 116 or taper provide a fluid passage between dip tube 103 and pump chamber 114 when the valve member 110 is in its uppermost position (as shown in FIG. 2). Upper portion 111 of valve member 110 includes an upwardly-facing valve surface 131 which seats against a valve seat 132 on plunger 105. Projecting through valve seat 132 is a spring retainer 133, which includes a spring retaining rim 134. A valve spring 135 is captured between retaining rim 134 and valve seat 132, thereby urging valve surface 131 into engagement with valve seat 132 to seal off the pump chamber 114 from the nozzle 106. Valve member 110 is designed, as with other precompression pumps, so that it has an upwardly-facing net area upon which pressure within the pump chamber 114 acts.

In operation, the pump is initially held in the rest position shown in FIG. 1. Finger pressure is then applied to the top of the actuator 107, against the force of spring 118. Downward movement of actuator 107 moves piston 104 downwardly, pushing valve member 110 down so that seal 102 slides down until it seats on seating surface 140. Further downward movement of piston 104 moves the slots 116 below the seal 102, thereby cutting off fluid communication between pump chamber 114 and dip tube 103. Continued downward movement of piston 104 pressurizes the fluid in the pump chamber 114. When the fluid in the chamber 114 is pressurized to a sufficiently high level, the downward force it creates on the valve member 110 (and specifically the upwardly-facing area of valve member 110) overcomes the upward force created by valve spring 135, thereby drawing valve surface 131 away from valve seat 132. This movement opens the fluid passage between pump chamber 114 and the nozzle 106, allowing liquid to flow from the pump chamber and thereafter through the nozzle 106 as a fine mist.

Upon release of the actuator 107 by an operator's finger, spring 118 urges actuator 107 upwardly, pulling piston 104 upwardly. Release of finger pressure on actuator 107 ends pressurization of the pump chamber 114; as a result, the valve spring 135 pulls valve member 110 upwardly, seating valve surface 131 on valve seat 132, thereby sealing the fluid communication between the nozzle 106 and the pump chamber 114. Upward movement of the valve member 110 also causes the seal 102 to be drawn up from seating surface 140, establishing fluid communication between dip tube 103 and pump chamber 114. Upward movement of the piston 104 under the action of the spring 118 causes an increase in the volume of the pump chamber 114, and a resulting decrease in the pressure in that chamber. This decrease in pressure draws liquid up around the seal 102 and into the chamber 114. Seal 102 moves upwardly until held in place by bead 125, at which point it is restrained from further upward movement, while still allowing fluid flow around it (as described in U.S. Pat. No. 4,389,003).

As can be seen from the above description, the only spring force which a user must overcome in depressing the actuator is that of spring 118. Spring 135 acts only to hold the outlet valve closed, and does not act against downward depression of the actuator 107. Since spring 118 must only be strong enough to return the piston 104 after release of the actuator 107, this spring can be relatively light, and therefore much easier for a user to depress. Furthermore, as in the previous embodiment, this pump is comprised of springs which are made entirely of plastic, and the pumps are therefore easy to recycle.

Figure 3:
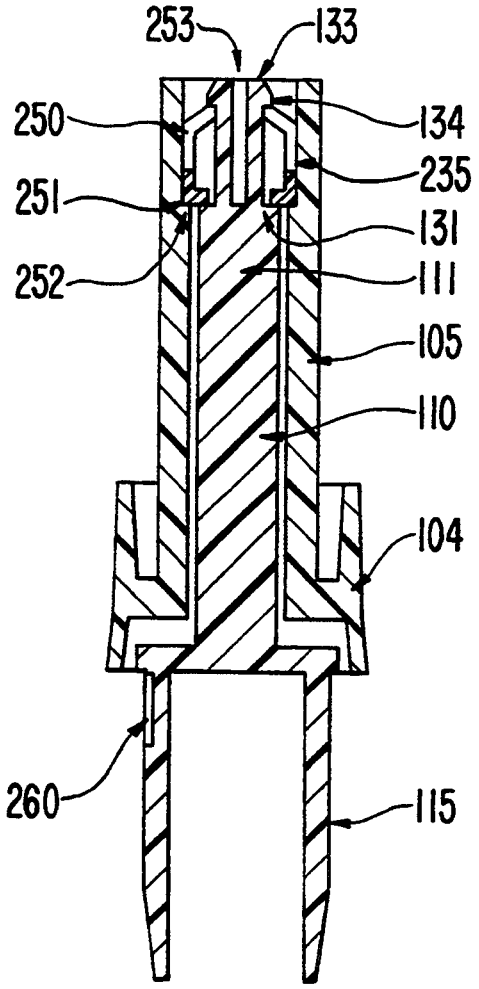
FIG. 3 is a cross-sectional view of an alternative spring arrangement for the embodiment of FIG. 2.

FIG. 3 shows an alternative spring configuration for the embodiment shown in FIG. 2. FIG. 3 shows only the piston, plunger, valve spring and valve member; all other parts are identical to those shown in FIG. 2 and described above. In the arrangement of FIG. 3, the valve spring 235 is made of a leaf-type spring, unlike the helical coil spring shown in FIG. 2. The spring 235 in FIG. 3 is also constructed of plastic, but includes a series of upwardly-extending resilient leafs or fingers 250 which are held underneath spring retaining rim 134. The fingers 250 extend upwardly from an inwardly-extending rim 251. Rim 251 acts to hold spring 235 in place against a ledge 252 in plunger 105, and also acts as the valve seat for valve surface 131. Spring retainer 133 may include (in this configuration or in the configuration of FIG. 2) a slot 253 to allow rim 134 to more easily be snapped over the spring 235 or 135. Valve member 110 may include (in this configuration or in the configuration of FIG. 2) a groove 260 to allow trapped air to be exhausted from the pump chamber at the lowermost position of the piston. Slot 260 could be replaced with a reduced diameter portion at the uppermost portion of lower portion 115.

I claim:

1. A dispenser for dispensing a spray of pressurized fluid comprising:

a pump housing, said pump housing having an inlet opening at its inner end;

a piston stem having a piston mounted thereon for reciprocal motion within said pump housing, said piston stem including an outlet passage therethrough;

a mounting cup into which said pump housing is fastened and through which said piston stem projects;

a valve member mounted for movement within the pump housing, the valve member comprising an inlet valve portion cooperating with said inlet opening and an outlet valve portion cooperating with said outlet passage, wherein inward movement of said inlet valve portion acts to close said inlet opening and inward movement of said outlet valve portion acts to open said outlet passage, said valve member further comprising a pressure area;

a first spring, said first spring biasing said piston outwardly;

a second spring, said second spring biasing said outlet valve portion toward said outlet passage;

wherein inward movement of the piston results in increased fluid pressure within said pump housing, said increased fluid pressure acting on said pressure area against the bias of said second spring so that a predetermined fluid pressure will move said outlet valve portion away from said outlet passage.

2. The dispenser of claim 1, further comprising:

an actuator mounted on said piston stem, wherein said first spring is located between said mounting cup and said actuator.

3. The dispenser of claim 2, wherein:

said second spring is located outside said mounting cup.

4. The dispenser of claim 1, wherein:

said second spring is located outside said mounting cup.

5. The dispenser of claim 1, wherein:

said first and second springs are constructed of a non-metallic material.

6. The dispenser of claim 5, wherein:

said first and second springs are constructed of plastic.

7. The dispenser of claim 1, wherein:

said piston stem comprises a valve seat in said outlet passage, said outlet valve portion seating against said valve seat to close said outlet passage.

8. The dispenser of claim 7, wherein:

an outermost portion of said outlet portion extends through said valve seat and includes a radially-outwardly projecting ridge, said second spring being held between said valve seat and said ridge.

9. The dispenser of claim 1, wherein:

said second spring comprises a valve seat in said outlet passage, said outlet valve portion seating against said valve seat to close said outlet passage.

10. The dispenser of claim 9, wherein:

an outermost portion of said outlet portion extends through said valve seat and includes a radially-outwardly projecting ridge, said second spring comprising fingers, the outermost ends of said fingers being held under said ridge.

11. The dispenser of claim 9, wherein:

said second spring is constructed of plastic.

12. A dispenser for dispensing a spray of pressurized fluid comprising:

a pump housing, said pump housing having an inlet opening at its inner end;

a piston stem having a piston mounted thereon for reciprocal motion within said pump housing, said piston stem including an outlet passage therethrough;

an actuator mounted on said piston stem;

a mounting cup through which said piston stem projects;

a valve member mounted for movement within the pump housing, the valve member comprising an inlet valve portion cooperating with said inlet opening and an outlet valve portion cooperating with said outlet passage, wherein inward movement of said inlet valve portion acts to close said inlet opening and inward movement of said outlet valve portion acts to open said outlet passage; and a pump spring, said pump spring biasing said piston outwardly, said spring being mounted between said mounting cup and said actuator.

13. The dispenser of claim 12, further comprising:

a valve spring, said valve spring biasing said valve member outwardly.

14. The dispenser of claim 13, wherein:

said valve spring is located outside said mounting cup.

15. The dispenser of claim 12, wherein:

said pump spring is constructed of a non-metallic material.

16. The dispenser of claim 15, wherein:

said pump spring is constructed of plastic.

17. The dispenser of claim 12, wherein:

said piston stem comprises a valve seat in said outlet passage, said outlet valve portion seating against said valve seat to close said outlet passage.

18. The dispenser of claim 13, wherein:

an outermost portion of said outlet portion extends through said valve seat and includes a radially-outwardly projecting ridge, said valve spring being held between said valve seat and said ridge.

19. The dispenser of claim 13, wherein:

said valve spring comprises a valve seat in said outlet passage, said outlet valve portion seating against said valve seat to close said outlet passage.

20. The dispenser of claim 17, wherein:

an outermost portion of said outlet portion extends through said valve seat and includes a radially-outwardly projecting ridge, said second spring comprising fingers, the outermost ends of said fingers being held under said ridge.

21. The dispenser of claim 20, wherein:

said valve spring is constructed of plastic.

22. A dispenser for dispensing a spray of pressurized fluid comprising:

a pump housing, said pump housing having an inlet opening at its inner end;

a pump stem having a piston mounted thereon for reciprocal motion within said pump housing, said pump stem including an outlet passage therethrough;

a valve member mounted for movement within the pump housing, the valve member comprising an inlet valve portion cooperating with said inlet opening and an outlet valve portion cooperating with said outlet passage, wherein inward movement of said inlet valve portion acts to close said inlet opening and inward movement of said outlet valve portion acts to open said outlet passage;

a pump spring coupled to said piston, said pump spring biasing said piston outwardly, said pump spring being located outside said pump housing, only said pump spring biasing said piston outwardly;

said pump housing, pump stem, piston, valve member and spring all being constructed of a plastic material.

23. A method of constructing a dispenser for dispensing a spray of pressurized fluid comprising the steps of:

providing a pump housing having an inlet opening at its inner end;

mounting a piston stem having an outlet passage therethrough and a piston mounted thereon within said pump housing for reciprocal motion;

mounting a valve member comprising an inlet valve portion cooperating with said inlet opening, an outlet valve portion cooperating with said outlet passage, and a pressure area, for movement within the pump housing so that inward movement of said inlet valve portion acts to close said inlet opening and inward movement of said outlet valve portion acts to open said outlet passage;

mounting a mounting cup through which said piston stem projects to said pump housing;

providing a first spring for biasing said piston outwardly; and providing a second spring for biasing said outlet valve portion toward said outlet passage;

such that inward movement of the piston results in increased fluid pressure within said pump housing, said increased fluid pressure acting on said pressure area against the bias of said second spring so that a predetermined fluid pressure will move said outlet valve portion away from said outlet passage.

24. A method of constructing a dispenser for dispensing a spray of pressurized fluid comprising the steps of:

providing a pump housing having an inlet opening at its inner end;

mounting a piston stem having an outlet passage therethrough and a piston mounted thereon within said pump housing for reciprocal motion;

mounting an actuator on said piston stem;

mounting a valve member comprising an inlet valve portion cooperating with said inlet opening, an outlet valve portion cooperating with said outlet passage, and a pressure area, for movement within the pump housing so that inward movement of said inlet valve portion acts to close said inlet opening and inward movement of said outlet valve portion acts to open said outlet passage;

mounting a mounting cup through which said piston stem projects to said pump housing;

mounting a pump spring between said mounting cup and said actuator to bias said piston outwardly.

25. A method of constructing a dispenser for dispensing a spray of pressurized fluid comprising the steps of:

providing a plastic pump housing having an inlet opening at its inner end;

mounting a plastic piston stem having an outlet passage therethrough and a piston mounted thereon within said pump housing for reciprocal motion;

mounting an actuator on said piston stem;

mounting a plastic valve member comprising an inlet valve portion cooperating with said inlet opening, an outlet valve portion cooperating with said outlet passage, for movement within the pump housing so that inward movement of said inlet valve portion acts to close said inlet opening and inward movement of said outlet valve portion acts to open said outlet passage;

mounting a mounting cup through which said piston stem projects to said pump housing; and mounting a plastic pump spring outside said pump housing and coupling said plastic pump spring to said piston to bias said piston outwardly, said plastic pump spring thereby providing the only biasing force to said piston.

* * * * *

UNITED STATES PATENT AND TRADEMARK OFFICE

CERTIFICATE OF CORRECTION

PATENT NO. : 5,392,962

DATED : Feb. 28 1995

INVENTOR(S) : Philip MESHBERG

It is certified that error appears in the above-indentified patent and that said Letters Patent is hereby corrected as shown below:

| Column | Line | |
|---|---|---|
| 8 | 32 | Delete "and a pressure area,". |

Signed and Sealed this

Thirteenth Day of June, 1995

*Attest:*

*Attesting Officer*

Bruce Lehman

BRUCE LEHMAN

*Commissioner of Patents and Trademarks*